US012758847B2

(12) United States Patent
Karinen-Irvine

(10) Patent No.: US 12,758,847 B2
(45) **Date of Patent: *Oct. 13, 2026**

(54) PICKLEBALL IDENTIFICATION DEVICE AND METHOD OF USE

(71) Applicant: Vicki Lynn Karinen-Irvine, Prescott, AZ (US)

(72) Inventor: Vicki Lynn Karinen-Irvine, Prescott, AZ (US)

( * ) Notice: Subject to any disclaimer, the term of this patent is extended or adjusted under 35 U.S.C. 154(b) by 212 days.

This patent is subject to a terminal disclaimer.

(21) Appl. No.: 18/887,860

(22) Filed: Sep. 17, 2024

(65) Prior Publication Data

US 2025/0099835 A1 Mar. 27, 2025

Related U.S. Application Data

(60) Provisional application No. 63/540,072, filed on Sep. 24, 2023.

(51) Int. Cl.
*A63B 71/06* (2006.01)

(52) U.S. Cl.
CPC .. *A63B 71/0619* (2013.01); *A63B 2071/0694* (2013.01)

(58) Field of Classification Search
None
See application file for complete search history.

(56) References Cited

U.S. PATENT DOCUMENTS 4,024,657 A * 5/1977 Dutcher ..... G09F 19/02 446/379

OTHER PUBLICATIONS

Emil Burada, How to Make a Cone out of Paper, Jun. 4, 2023, Youtube, https://www.youtube.com/watch?v=NvbKOwRajZk (Year: 2023).*

Wayne Coble, Wiffle Ball Sinker, Nov. 30, 2016, SaltWater Sportsman, https://www.saltwatersportsman.com/fishing-rigs-wiffle-ball-sinker/ (Year: 2016).*

* cited by examiner

*Primary Examiner* — Eugene L Kim
*Assistant Examiner* — Samantha M Berry
(74) *Attorney, Agent, or Firm* — Eric Hanscom

(57) ABSTRACT

A pickleball identifier and method of personalizing and identifying a pickleball involves inserting a rolled-up polyester/silk circle or oval of fabric into one of the holes in the pickleball, then allowing it to snap open once fully inserted. The circle or oval has an identifying color, written or printed name, or other indicia so that the owner of the pickleball can retain ownership after a game is finished. Because of the circular shape, the identifier has no edges or other protuberances that can fray or be pulled upon to remove the identifier from the pickleball. Should the pickleball crack during play, the identifier can be removed and inserted into another pickleball.

18 Claims, 2 Drawing Sheets

PICKLEBALL IDENTIFICATION DEVICE AND METHOD OF USE

CROSS REFERENCE TO RELATED APPLICATIONS

This utility patent application claims priority back to U.S. Provisional No. 63/540,072, with a filing date of Sep. 24, 2023, the contents of which are incorporated by reference into this utility patent application.

STATEMENT REGARDING FEDERALLY SPONSORED RESEARCH OR DEVELOPMENT

This invention was not federally sponsored.

BACKGROUND OF THE INVENTION

Field of the Invention

This invention relates to the general field of the sport of pickleball, and more specifically toward an identifier that can be inserted into a pickleball to allow users to personalize and identify their balls.

General Background of the Sport of Pickleball and the Need for the Invention The sport of pickleball was invented on Bainbridge Island, Washington in 1965, by two neighbors to keep their families occupied and it's been spreading to all age demographics ever since. It's no longer considered a game for retirees; quite the contrary, the sport of pickleball has been the fastest-growing sport in the United States and probably the world for the past three year. Pickleball equipment sales have increased nearly 500% since 2020—with an estimated 36 million players just in the US—and projections are even higher for the next five years. The popularity of pickleball comes from, among other aspects, the smaller size of the court (as compared with tennis), which allows pickleball courts to be housed indoors, on cruise ships, or in other space-limited settings. In addition, it's fast pace and low entry cost make it popular with many While the origin of the name "pickleball" may be traced to the name of a dog or the selection of a rowing crew is somewhat sketchy, there is little doubt that the pickleball industry will become a dominant force in the recreational industry for years to come.

With so many people playing Pickleball, it's only logical that identifying who's ball belongs to who is not easy. This is a very fast game, with the balls flying all over (both inside and even outside) Pickleball courts. At an average cost of between $2 to $4 for each Pickleball, (depending on the brand name), it can get expensive if a player cannot keep track of his/her balls. Proper identification of each player's own balls can also avoid potential arguments over ball ownership.

Statement of the Problem Solved

Since most pickleball players bring to the court both their paddle and one or more balls, and with pickleballs frequently entering other pickleball courts, there is often a problem keeping track of whose balls are whose.

Prior Art

There are prior art attempts to allow users to keep track of an individual's pickleballs, but these have not proven successful. For example, users can use markers or pens to write on the exterior surface of the pickleballs, but these markings will fade quickly, as by the nature of the game, the pickleballs are hit by paddles and bounced off the ground.

Another attempt at pickleball identification has been to engrave a user's name or initials into the exterior of the pickleball. While this may sound like a good solution, gouging away material from the surface can lead to both a weakened ball and to irregular flight paths, similar to a pitcher in baseball who "scuffs" one side of the ball to make it fly unexpectedly such that a batter misses his or her swing at the ball. Some pickleball users have tried to avoid this problem by filling in the engraved section so as to recreate the exact dimensions of the original exterior. This method, however, requires that the user use a material with the exact density of the pickleball to avoid "weighting" one side of the ball. Anyone questioning whether weighting one side of a pickleball would affect the flight trajectory need only look at baseball's outlawing of the "spitball" and other pitching cheats that involve putting an irregularity on one side of an otherwise-spherical baseball.

However, none of the prior art offers a device and means of identifying a pickleball which is a) permanent, and b) does not affect the strength or trajectory of the pickleball. The current invention provides just a solution with circle that can be rolled up and inserted through a hole in a pickleball, where the circle snaps open upon insertion and is retained within the pickleball. Optionally, a user may give the pickleball a gentle shake to "spring open" the rolled up circle, or, again optionally, may insert a plastic or paper straw to encourage the opening of the circle. In essence, the invention provides a pickleball identifier and method of personalizing and identifying the pickleball.

The circle has an identifying color, written or printed name, or other indicia so that the owner of the pickleball can retain ownership after a game is finished, or when their pickleball flies into another pickleball court. In a preferred embodiment of the invention, the circles are between 2" and 4" in diameter. Because of the circular shape and edge-sealing, the identifier has no edges or other protuberances that can fray or be pulled upon to remove the identifier from the pickleball. Should the pickleball crack during play, the identifier can be removed and inserted into another pickleball.

Optionally, an oval shape can be used. A preferred embodiment of the oval shape has a length of between 1" and 4", with a width between 0.5" and 3".

The material used in a preferred embodiment of the invention is a lightweight blend of polyester and silk, sealed around the perimeter, so it does not fray. This is important as should the circle fray, threads could stick out of the holes, affecting the way the ball hits the paddle or the ground, and in extreme cases, cause the circle to be pulled entirely out of the pickleball. The polyester/silk combination is non-lasting, recyclable, and easy to write on with a pen or permanent marker.

SUMMARY OF THE INVENTION

The current invention provides just such a solution by providing a pickleball identifier and method of personalizing and identifying a pickleball involves inserting a rolled-up polyester/silk circle of fabric into one of the holes in the pickleball, then allowing it to snap open once fully inserted. The circle has an identifying color, written or printed name, or other indicia so that the owner of the pickleball can retain ownership after a game is finished. Because of the circular or oval shape, the identifier has no edges or other protuberances that can fray or be pulled upon to remove the identifier from the pickleball. Should the pickleball crack during play, the identifier can be removed and inserted into another pickleball.

It is a principal object of the invention to provide a device that can be inserted through a hole in a pickleball to show ownership of that particular pickleball.

It is another object of the invention to provide a method by which a pickleball owner can identify his/her pickleballs by an inexpensive, easy-to-use, and effective method.

There has thus been outlined, rather broadly, the more important features of the invention in order that the detailed description thereof may be better understood, and in order that the present contribution to the art may be better appreciated. There are additional features of the invention that will be described hereinafter and which will form the subject matter of the claims appended hereto. The features listed herein and other features, aspects and advantages of the present invention will become better understood with reference to the following description and appended claims.

BRIEF DESCRIPTION OF THE FIGURES

The accompanying drawings, which are incorporated in and form a part of this specification, illustrate embodiments of the invention and together with the description, serve to explain the principles of this invention.

DETAILED DESCRIPTION OF THE INVENTION

Figure 1:
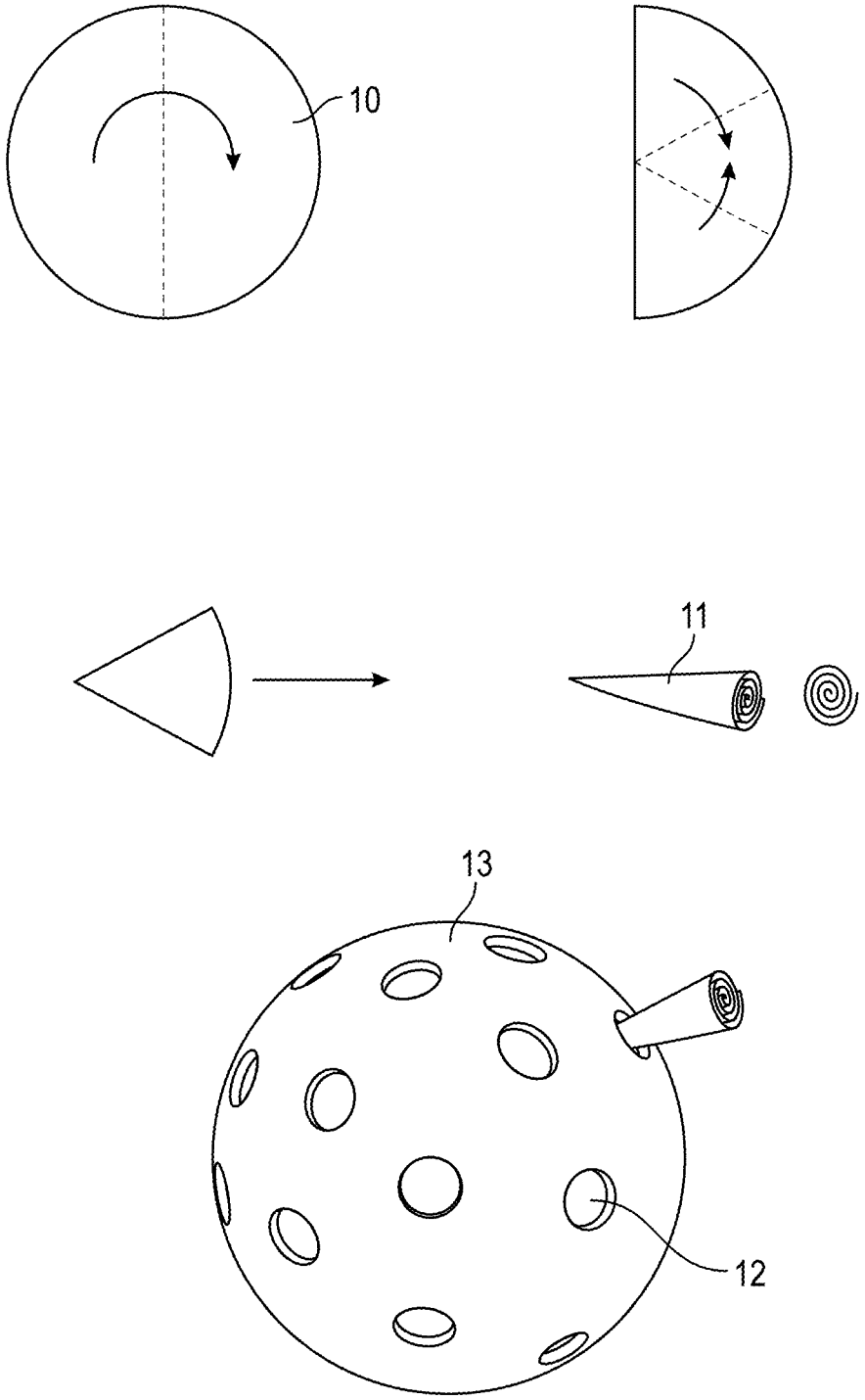
FIG. 1 is a sequential view of the invention being prepared and inserted into a pickleball. This figure illustrates the "circle" version of the invention; the oval version is similar in function but is an oval rather than a circle.

Many aspects of the invention can be better understood with the references made to the drawings below. The components in the drawings are not necessarily drawn to scale. Instead, emphasis is placed upon clearly illustrating the components of the present invention. Moreover, reference numerals designate corresponding parts through the several views in the drawings.

FIG. 1 is a sequential view of the invention being prepared and inserted into a pickleball. In a first step, indicated be general reference number 1, the identifying circle 10 is folded over. In a second step, indicated be general reference number 2, the folded-over circle is then folded again into thirds. In a third step, indicated by general reference number 3, the circle is then rolled up into a narrow, cone-shape 11. In a fourth step, indicated by the general reference number 4, the narrow cone-shape 11 in then inserted through a hole 12 in the pickleball 13. This figure illustrates the "circle" version of the invention; the oval version is similar in function but is an oval rather than a circle.

Figure 2:
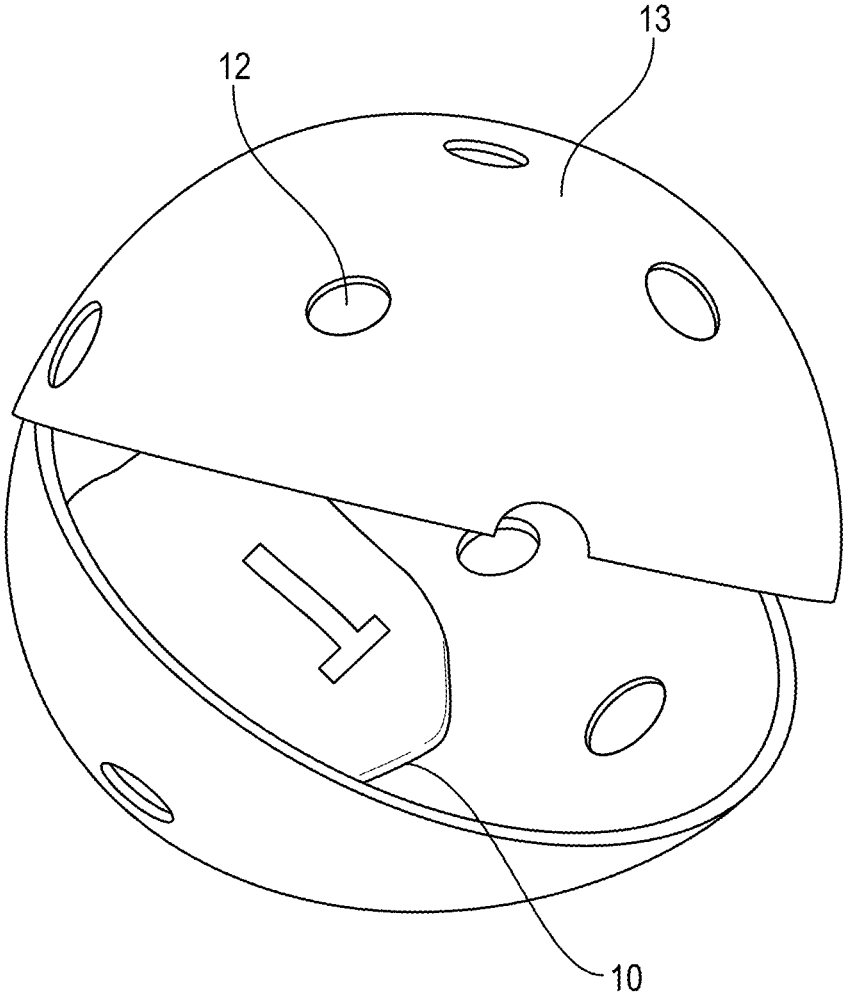
FIG. 2 is a perspective, cut-away view of the invention after the narrow, cone-shape from step has been fully inserted into the hole in the pickleball, and allowed to snap back to its original position.

FIG. 2 is a perspective, cut-away view of the invention after the narrow, cone-shape from step 4 has been fully inserted into the hole 12 in the pickleball 13, and allowed to snap back to its original position. In a fifth step, indicated by general reference number 5, the circle snaps back to its original shape. Optionally, a user may find that giving the pickleball a gentle shake will help the narrow, cone-shape to snap open, back to its original flat shape. Again, optionally, the user may use a straw to assist the circle in opening.

In a preferred embodiment, identifying circles with a diameter between 1" and 4" are used. This allows the circle, when opened, to rest easily withing the pickleball and not affect its path. The inventor has found that preferred embodiments with diameters of 1", 1.5", 2.0", 2.5" and 3" fit well within the different brands of pickleballs with different hole patterns. Optionally, an oval shape can be used.

In another preferred embodiment, identifying ovals with a length between 1" and 4", and a width of between 0.5" and 3" are provided.

It should be understood that while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

What I claim is:

1. A method for identifying a pickleball, consisting of the steps of:

first, obtaining a fabric circle with an original, flat shape; second, rolling it into a narrow, cone-like shape; third, inserting the narrow, cone-like shape into a hole in a pickleball;

fourth, allowing the narrow, cone-like shape to snap back to the original, flat shape; and fifth, inserting a straw through the hole in the pickleball to push open the narrow, cone-like shape to revert the narrow cone-like shape to the original, flat shape.

2. The method of claim 1, where the fabric circle in the original, flat shape has a diameter of between 1" and 4".

3. The method of claim 2, where the fabric circle is a lightweight blend of polyester and silk.

4. The method of claim 3, where the second step of rolling the fabric circle into a narrow, cone-shape consists of first, folding the fabric circle in half, resulting in a semi-circular shape, and second, folding the semi-circular shape in thirds, resulting in a narrow, flat shape, then rolling the narrow, flat shape into the narrow, cone-like shape.

5. The method of claim 4, where the fabric circle is made from a bendable, shape-resilient material such that when the narrow, cone-like shape is inserted into the hole in the pickleball, the narrow, cone-like shape reverts to the original, flat shape.

6. The method of claim 5, where the pickleball is gently shaken to assist the narrow, cone-like shape to revert to the original, flat shape.

7. The method of claim 5, where the fabric circle in the original, flat shape has a diameter of 3.0".

8. A method for identifying a pickleball, comprising the steps of:

first, obtaining a fabric circle with an original, flat shape; second, rolling it into a narrow, cone-like shape; third, inserting the narrow, cone-like shape into a hole in a pickleball;

fourth, allowing the narrow, cone-like shape to snap back to the original, flat shape; and fifth, inserting a straw through the hole in the pickleball to push open the narrow, cone-like shape to revert the narrow cone-like shape to the original, flat shape.

9. The method of claim 8, where the fabric circle in the original, flat shape has a diameter of between 1" and 4".

10. The method of claim 9, where the fabric circle is a lightweight blend of polyester and silk.

11. The method of claim 10, where the second step of rolling the fabric circle into a narrow, cone-shape consists of first, folding the fabric circle in half, resulting in a semi-circular shape, and second, folding the semi-circular shape in thirds, resulting in a narrow, flat shape, then rolling the narrow, flat shape into the narrow, cone-like shape.

12. The method of claim 11, where the fabric circle is made from a bendable, shape-resilient material such that when the narrow, cone-like shape is inserted into the hole in the pickleball, the narrow, cone-like shape reverts to the original, flat shape.

13. The method of claim 12, where the pickleball is gently shaken to assist the narrow, cone-like shape to revert to the original, flat shape.

14. The method of claim 12, where the fabric circle in the original, flat shape has a diameter of 1.0".

15. The method of claim 12, where the fabric circle in the original, flat shape has a diameter of 1.5".

16. The method of claim 5, where the fabric circle in the original, flat shape has a diameter of 2.0".

17. A method for identifying a pickleball, consisting of the steps of:

first, obtaining a fabric oval with an original, flat shape; second, rolling it into a narrow, cone-like shape; third, inserting the narrow, cone-like shape into a hole in a pickleball;

fourth, allowing the narrow, cone-like shape to snap back to the original, flat shape; and fifth, inserting a straw through the hole in the pickleball to push open the narrow, cone-like shape to revert the narrow cone-like shape to the original, flat shape.

18. The method of claim 17, where the fabric oval in the original, flat shape has a length between 1" and 4" and a width between 0.5" and 3".

* * * * *